US005722016A

United States Patent [19]

Godlove et al.

[11] Patent Number: 5,722,016

[45] Date of Patent: Feb. 24, 1998

[54] ELECTROSTATOGRAPHIC IMAGING MEMBER ASSEMBLY

[75] Inventors: Ronald E. Godlove, Bergen, N.Y.; Venita A. Jordan, Englewood, Ohio; Robert E. McCumiskey, Rochester, N.Y.; Huoy-Jen Yuh, Pittsford, N.Y.; Kamran U. Zaman, Henrietta, N.Y.

[73] Assignee: Xerox Corporation, Stamford, Conn.

[21] Appl. No.: 748,890

[22] Filed: Nov. 28, 1995

Related U.S. Application Data

[63] Continuation of Ser. No. 296,564, Aug. 26, 1994, abandoned.

[51] Int. Cl.[6] ..... G03G 15/00

[52] U.S. Cl. ..... 399/159

[58] Field of Search ..... 399/159; 29/895.2, 29/895.32, 458, 530

[56] References Cited

U.S. PATENT DOCUMENTS

| | | | |
|---|---|---|---|
| 3,646,652 | 3/1972 | Heiligenthal et al. . | |
| 4,023,967 | 5/1977 | McGibbon . | |
| 4,292,386 | 9/1981 | Takano . | |
| 4,317,270 | 3/1982 | Watanabe et al. . | |
| 4,378,622 | 4/1983 | Pinkston et al. . | |
| 4,601,963 | 7/1986 | Takahaghi et al. | 430/56 X |
| 5,160,421 | 11/1992 | Melnyk et al. | 205/67 |
| 5,430,526 | 7/1995 | Ohkubo et al. . | |

FOREIGN PATENT DOCUMENTS

| | | | |
|---|---|---|---|
| 0060480 | 3/1988 | Japan | 355/211 |
| 0060481 | 3/1988 | Japan | 355/211 |
| 0035166 | 2/1993 | Japan | 355/211 |
| 0035167 | 2/1993 | Japan | 355/211 |
| 0188839 | 7/1993 | Japan | 355/211 |

*Primary Examiner*—Matthew S. Smith

[57] ABSTRACT

An electrostatographic imaging member assembly including an electrostatographic imaging member including a substrate, an electrostatographic imaging layer, an imaging surface on the imaging layer, a back surface on the substrate, and a preformed resilient porous gas filled acoustic dampening member at least partially compressed and in pressure contact with the back surface, the pressure contact being sufficent to substantially eliminate relative movemement between the substrate and the acoustic dampening member.

5 Claims, 5 Drawing Sheets

ELECTROSTATOGRAPHIC IMAGING MEMBER ASSEMBLY

This is a continuation of Application No. 08/296,564 filed Aug. 26, 1994 now abandoned.

BACKGROUND OF THE INVENTION

This invention relates in general to an electrostatographic imaging member and more specifically to an assembly comprising an electrostatographic imaging member and acoustic dampening means.

Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of each drum. The hub usually includes a flange extending into the interior of the drum. This flange is usually retained in place by an interference fit and/or an adhesive. An axle shaft through a hole in the center of each hub supports the hub and drum assembly. Electrostatographic imaging members may be electrophotographic members or electrographic. It is well known that electrophotographic members comprise at least one photosensitive imaging layer and are imaged with the aid of activating radiation in image configuration whereas electrographic imaging members comprise at least one dielectric layer upon which an electrostatic latent image is formed directly on the imaging surface by shaped electrodes, ion streams, styli and the like. A typical electrostatographic imaging process cycle involves forming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members.

When electrostatographic imaging members are cleaned by doctor type cleaning blades rubbing against the imaging surface to remove residual toner particles remaining on the imaging surface after toner image transfer to a receiving member, a high pitched ringing, squealing, squeaking, or howling sound can be created which is so intense that it is intolerable for machine operators. This is especially noted in drum type imaging members comprising a hollow cylindrical substrate. The sound apparently is caused by a "stick-slip" cycling phenomenon during which the cleaning blade initially "sticks" to the imaging surface and is carried in a downstream direction by the moving imaging surface to a point where resilience of the imaging blade forces the tucked blade to slip and slide back upstream where it again sticks to the photoreceptor and is carried downstream with the imaging surface until blade resilience again causes the blade to flip back to its original position. The upstream flipping motion kicks residual toner particles forward. The stick-slip phenomenon is somewhat analogous to the use of a push broom for cleaning floors where the push broom is most effective for cleaning when it is pushed a short distance and then tapped on the floor with the cycle being repeated again and again. This stick-slip phenomenon is important for effective removal of residual untransferred toner particles from an imaging surface and for prevention of undesirable toner film or toner comets from forming on the imaging surface during cleaning.

An adhesive relationship between the cleaning blade and the imaging member surface appears to contribute to the creation of the howling sound. More specifically, the stick-slip effect occurs where there is a strong adhesive interaction between the cleaning blade and the imaging surface. The howling sound appears to be caused by resonant vibration of the drum induced by the stick-slip phenomenon. Other factors contributing to creation of the screaming or howling sound may include factors such as the construction of the imaging member, the blade contacting the imaging member, the type of blade holder construction, and the like. For example, a flimsy blade holder can contribute to the howling effect. Moreover, a thinner, shorter, stubbier cleaning blade tends to contribute the howling effect. Thin imaging member drums can also lead to the howling effect. The stick-slip phenomenon also depends on the lubricating effect of toner and/or carrier materials utilized. Moreover, ambient temperatures can contribute to the creation of howling. It appears that resonance is initiated at the point of contact between the cleaning blade and the imaging member. The creation of the screaming or howling sound might be analogous to rubbing a fingertip around the edge of a wine glass. The screaming or howling noise phenomenon is especially noticeable for cylindrical photoreceptors having a hollow metal or plastic drum shaped substrate. Generally, where the imaging member is the cause of a howling sound, it will emit a ringing sound when tapped.

INFORMATION DISCLOSURE STATEMENT

U.S. Pat. No. 5,160,421 issued to A. Melnyk et al. on Nov. 3, 1992. An electroforming process is disclosed for preparing an electroformed metal layer on the inside surface of a female mandrel to form an electroform with a hollow interior. A device may be positioned within the hollow interior of the electroform, and the interior is filled with a filling material. The electroform may then be separated from the mandrel by a force applied to the device positioned within the filling material.

In a concurrently filed application entitled "ELECTROSTATOGRAPHIC IMAGING APPARATUS" filed in the name of E. A. Swain, an electrostatographic imaging member assembly is disclosed which includes a hollow cylindrical electrostatographic imaging member, the member including a substrate, an exterior imaging surface, an interior back surface, a first end and a second end, a substantially rigid cylindrical core support member located within the interior of and coaxially aligned with the cylindrical electrostatographic imaging member, the cylindrical core support member extending from at least the first end to the second end of the imaging member and having an outer surface spaced from the interior back surface of the hollow cylindrical photoreceptor and at least one preformed resilient compressible sleeve under compression between the back surface of the imaging member and outer surface of the cylindrical core support, the compression being sufficient to render the electrostatographic imaging member substantially rigid and substantially free from distortion under electrostatographic image cycling conditions. A process for fabricating this imaging member is also disclosed.

Thus, there is a continuing need for improved electrostatographic imaging members that are more reliable and simpler to fabricate.

SUMMARY OF THE INVENTION

It is, therefore, an object of the present invention to provide an improved electrostatographic imaging member assembly which overcomes the above-noted disadvantages.

It is another object of this invention to provide an improved electrostatographic imaging member assembly which prevents high pitched ringing, squealing, squeaking, or howling sounds during blade cleaning.

It is still another object of this invention to provide an improved electrostatographic imaging member assembly which is simple to fabricate thereby eliminating complex fabrication process steps.

It is a further object of this invention to provide an improved electrostatographic imaging member assembly which is easily disassembled for recycling.

The foregoing and other objects of the present invention are accomplished by providing an electrostatographic imaging member assembly comprising an electrostatographic imaging member comprising a substrate, an electrostatographic imaging layer, an imaging surface on the imaging layer, a back surface on the substrate, and a preformed resilient porous gas filled acoustic dampening member at least partially compressed and in pressure contact with the back surface, the pressure contact being sufficient to substantially eliminate relative movement between the substrate and the acoustic dampening member. This electrostatographic imaging member assembly may be utilized in an electrostatographic imaging process.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices components thereof.

DETAILED DESCRIPTION OF THE DRAWINGS

The present invention may be employed in any suitable electrostatographic imaging member comprising a substrate, an electrostatographic imaging layer, an imaging surface on said imaging layer and a back surface that generate high pitched ringing, squealing, squeaking, or howling sounds when utilized with a cleaning device such as a cleaning blade. However, for purposes of illustration, the invention will be described with reference to an electrophotographic imaging drum.

Figure 1:
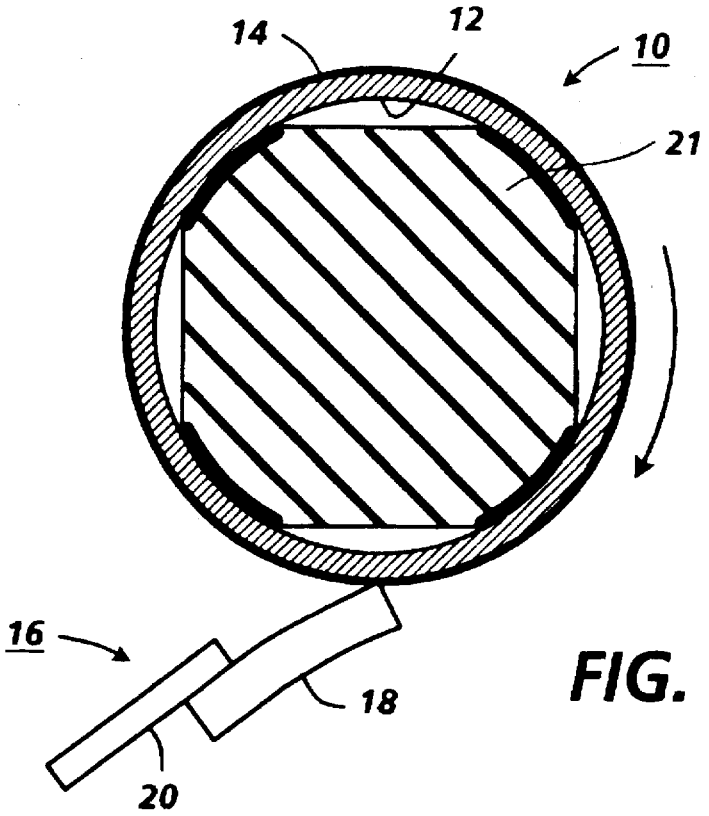
FIG. 1 illustrates a cross-sectional view of an electrostatographic imaging member containing a partially compressed foam block.

Referring to FIG. 1, an electrostatographic imaging member assembly is illustrated comprising a hollow electrostatographic imaging drum 10 comprising a hollow cylindrical substrate 12 and at least one electrophotographic imaging layer 14. Cylindrical substrate 12 may comprise any suitable material such as aluminum, nickel, plastic, and the like. Electrostatographic imaging layer 14 may comprise any suitable electrophotographic imaging material or an electrostatographic imaging material. Shown in contact with the outer imaging surface of electrophotographic imaging layer 14 is a cleaning blade assembly 16 comprising a resilient elastomeric cleaning blade 18 supported by a relatively rigid blade holder 20. Cleaning blade holder 20 may be supported by any suitable means such a machine housing (not shown) which also supports the electrostatographic imaging drum 10. Cleaning blade 18 is conventional and well known in the art. Any suitable cleaning blade and cleaning blade holder may be used with the electrostatographic imaging member assembly of this invention. In operation, electrostatographic imaging member 10 is rotated in the direction shown by the arrow so that the cleaning blade assembly 18 rubs across the outer imaging surface of layer 14 in a "doctor" or chiseling attitude. The stick-slip interaction between the cleaning blade 18 and the imaging surface of imaging layer 14 can cause howling sounds to occur when electrostatographic imaging member 10 does not contain a porous gas filled acoustic dampening members block 21 of one embodiment of this invention. Acoustic dampening member block 21, as illustrated in FIG. 1, normally has a configuration similar to that of a block with right angle corners and a square cross section prior to insertion into the interior of hollow cylindrical substrate 12. When acoustic dampening member block 21 is stuffed into the interior of the electrostatographic imaging member 10, the corners of dampening member block 21 are compressed at the regions in contact with the back surface of hollow cylindrical substrate 12. This ensures positive pressure contact between the partially compressed dampening member block 21 and the back surface of hollow cylindrical substrate 12. Pressure contact of the partially compressed dampening member block 21 substantially eliminates relative movement between block 21 and substrate 12. Relative movement of block 21 within hollow cylindrical substrate 12 can cause vibrations which adversely affect the quality of the final toner image. Also, pressure contact ensures elimination of the high pitched ringing, squealing, squeaking, or howling sounds. Porous gas filled acoustic dampening member block 21 may comprise any suitable porous gas filled material such as an open pore or closed pore sponge or expanded plastic foam.

Figure 2:
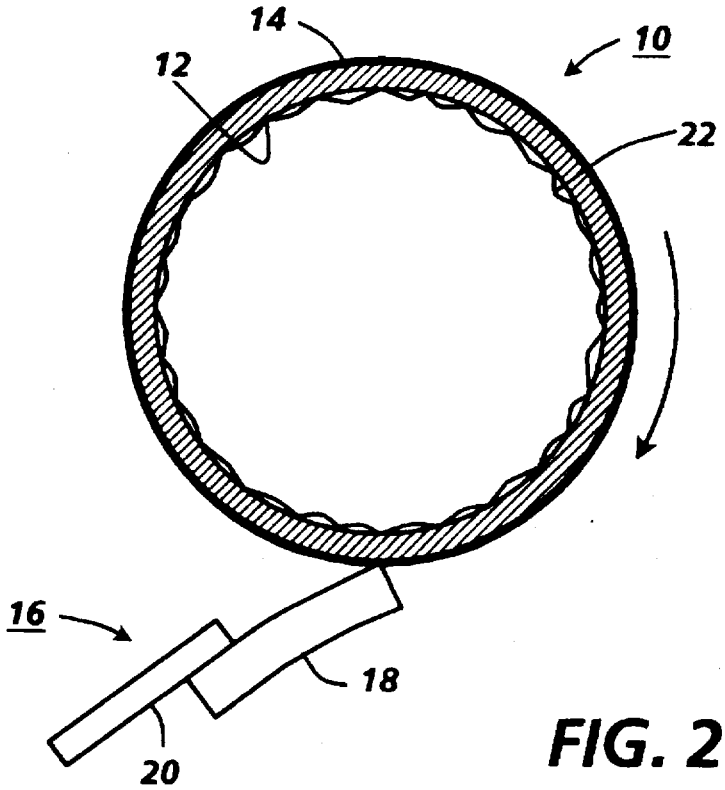
FIG. 2 illustrates a cross-sectional view of a cylindrical electrostatographic imaging member containing a corrugated foam or felt tube.

In FIG. 2, an electrostatographic imaging member assembly is illustrated that is similar to the member shown in FIG. 1 except that a corrugated porous gas filled acoustic dampening member sleeve 22 is substituted for the porous gas filled acoustic dampening member block 21 shown in FIG, 1. Dampening member sheet 22 a may comprise any suitable porous gas filled corrugated sheet material such as an open pore or closed pore corrugated cardboard, felt or expanded plastic foam sheet material. Prior to insertion into the interior of hollow cylindrical substrate 12, dampening member 22 has a generally hollow sleeve-like shape in the form of a sheet that has been rolled into the shape of a tube or it may have been molded or otherwise formed into a tubular shape with or without a seam. The outer dimensions of dampening member 22 should be sufficiently large so that it remains compressed slightly after positioning within imaging drum 10 and is in pressure contact with the back surface of cylindrical substrate 12. Corrugated porous gas filled acoustic dampening member sleeve 22 should also be sufficiently thick to retain its shape and remain in firm pressure contact with the interior surface of substrate 12. This compressive pressure contact ensures reduction or elimination of squealing or howling sounds that can occur when cleaning blade 18 contacts the outer imaging surface of electrostatographic imaging drum 10 and also prevents relative movement between sleeve 22 and substrate 12. The desired sleeve thickness depends on the resilience or stiffness of the sleeve material used. Thus, for example, stiffer sleeve materials can be thinner.

Figure 3:
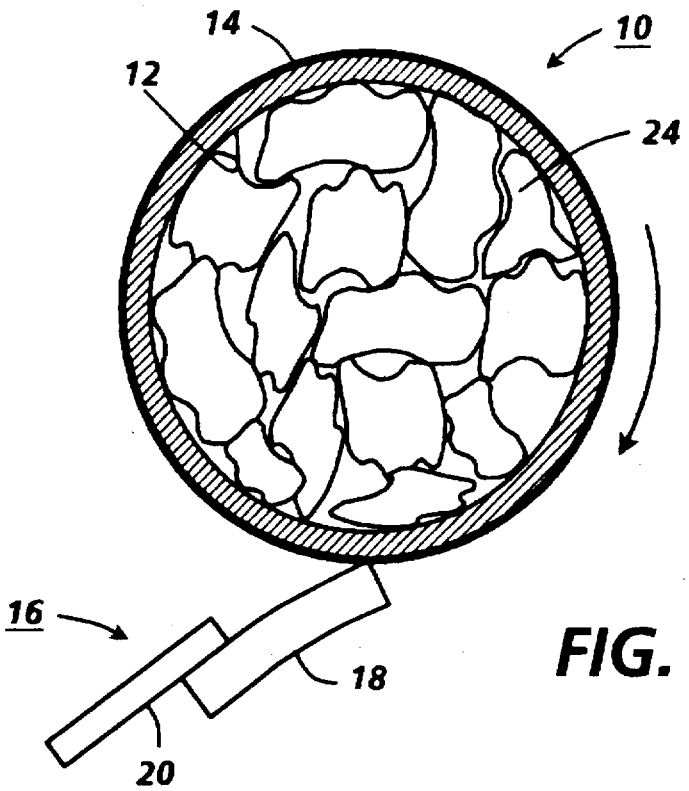
FIG. 3 illustrates a cross-sectional view of a cylindrical electrostatographic imaging drum containing irregular foam chips.

Shown in FIG. 3, is an electrostatocjraphic imaging member assembly similar to the member illustrated in FIG. 2 except that a plurality of expanded plastic foam pieces or chips 24 are substituted for the corrugated porous gas filled acoustic dampening member sleeve 22 shown in FIG. 2. Sufficient chips 24 should be present to maintain firm pressure contact between the outermost chips and the interior surface of substrate 12 so that at least some of the chips are at least partially compressed to ensure reduction or elimination of squealing or howling sounds that can occur when cleaning blade 18 contacts the outer imaging surface of electrostatographic imaging drum 10.

Figure 4:
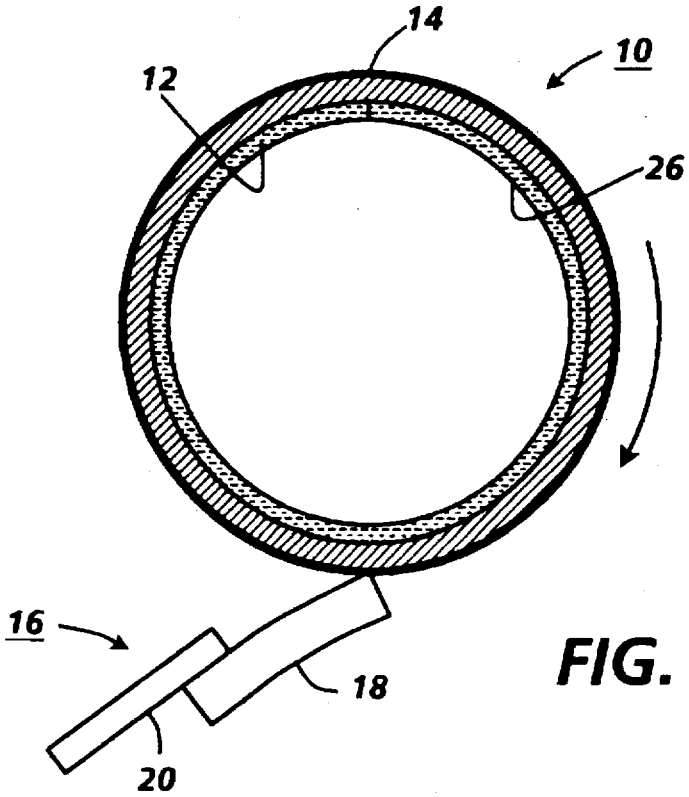
FIG. 4 illustrates a cross-sectional view of an electrostatographic imaging drum containing a unitary sleeve.

Illustrated in FIG. 4, is an electrostatographic imaging member assembly similar to the member illustrated in FIGS: 2 except that a single, unitary preformed expanded plastic foam tube 26 is substituted for the corrugated porous gas filled acoustic dampening member sleeve 22. Prior to insertion into the interior of hollow cylindrical substrate 12, preformed unitary expanded plastic foam tube 26 has an outside circumference slightly larger than the circumference of the interior surface (i.e back surface) of substrate 12. The dimensions of the preformed unitary expanded plastic foam tube 26 should be sufficiently large prior to mounting so that it is compressed slightly when it is in position within imaging drum 10 and in contact with the back surface of cylindrical substrate 12. As indicated above, compressive pressure contact ensures reduction or elimination of squealing or howling sounds that can occur during blade cleaning and prevents shifting of preformed expanded plastic foam tube 26 within the interior of imaging drum 10 during image formation. If desired, preformed expanded plastic foam tube 26 may have an outside circumference substantially the same as the circumference of the interior surface (i.e back surface). In this latter embodiment, preformed expanded plastic foam tube 26 can be held in place under partial compression within the interior of imaging drum 10 by any suitable means such as a flexible stay (not shown) similar to that shown in FIG. 9.

Figure 5:
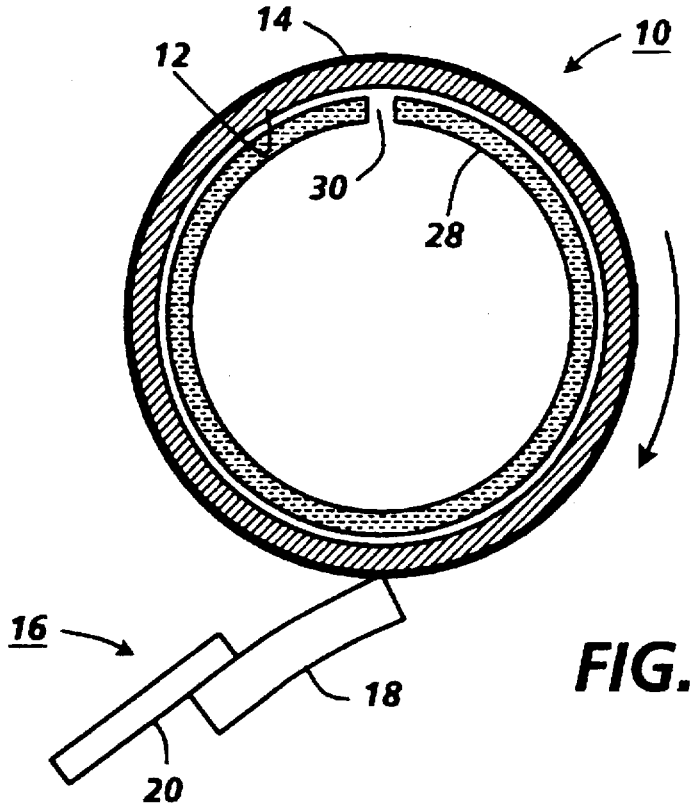
FIG. 5 illustrates a cross-sectional view of an expandable spiral cut sleeve containing a porous absorbing material.

In FIG. 5, an electrostatographic imaging member assembly is shown which is similar to the member illustrated in FIG. 4 except that a porous hollow split sleeve 28 is substituted for the preformed unitary expanded plastic foam tube 26 shown in FIG. 4. Gap 30 may form any suitable path or pattern such as a spiral path around the axis of cylindrical substrate 12 from one end of sleeve 28 toward the other end or extend in a straight line longitudinally of the sleeve parallel to an imaginary axis of sleeve 28. The shape of the spiral path is similar to that of the glued joint visible on a cardboard core for a paper towel roll. Preferably, the dimensions of preformed split sleeve 28 is sufficiently large prior to mounting so that it remains slightly compressed after installation within imaging drum 10 to ensure positive compressive pressure contact with the back surface of cylindrical substrate 12, i.e. after it springs open subsequent to insertion within cylindrical substrate 12. Preformed split sleeve 28 may comprise any suitable porous gas filled acoustic dampening material such as expanded plastic foam, corrugated cardboard, and the like. Unless a supplemental expanding means such as a flexible stay (not shown) is employed, it is important that porous hollow split sleeve 28 has sufficient restorative stiffness to hold itself in place within the interior of electrostatographic imaging member 10.

Figure 6:
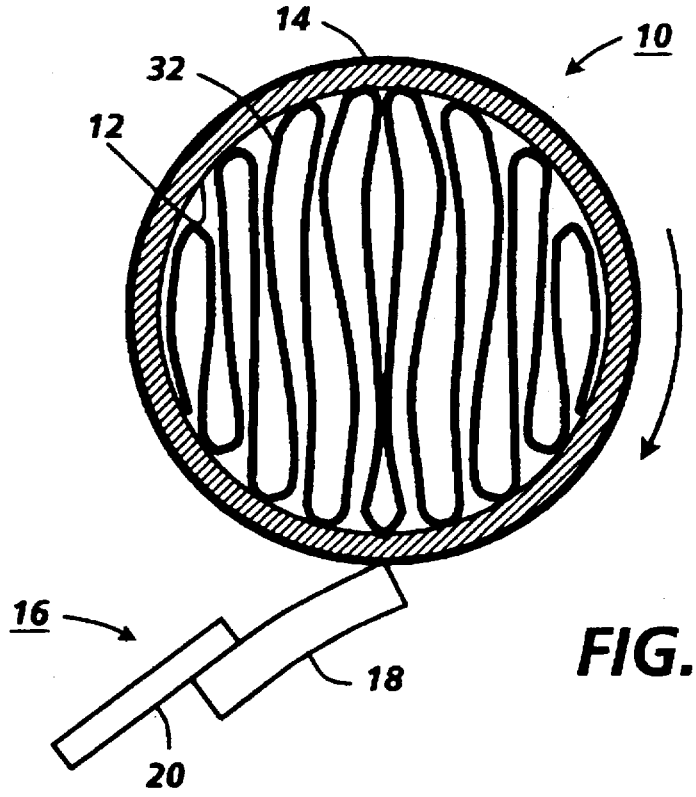
FIG. 6 illustrates a cross-sectional view of a cylindrical electrostatographic imaging member containing folded acoustic dampening sheets.

Shown in FIG. 6, is an electrostatographic imaging member assembly similar to the member illustrated in FIG. 5 except that a porous gas filled acoustic dampening member in the shape of a folded porous sheet 32 is substituted for the preformed split sleeve 28 shown in FIG. 5. Alternatively, a porous gas filled acoustic dampening member in the shape of a crumpled sheet or sheets (not shown) may be substituted for the porous gas filled folded sheet 32. Sheet 32 may comprise any suitable porous gas filled acoustic dampening material such as newspaper, paper towels, paper stationery, thin expanded plastic foam sheets, corrugated cardboard, and the like. Unless a stay or other suitable means is employed, folded porous sheet 32 should possess sufficient restorative force under partial compression to hold itself in place in firm pressure contact with the back surface of cylindrical substrate 12.

Figure 7:
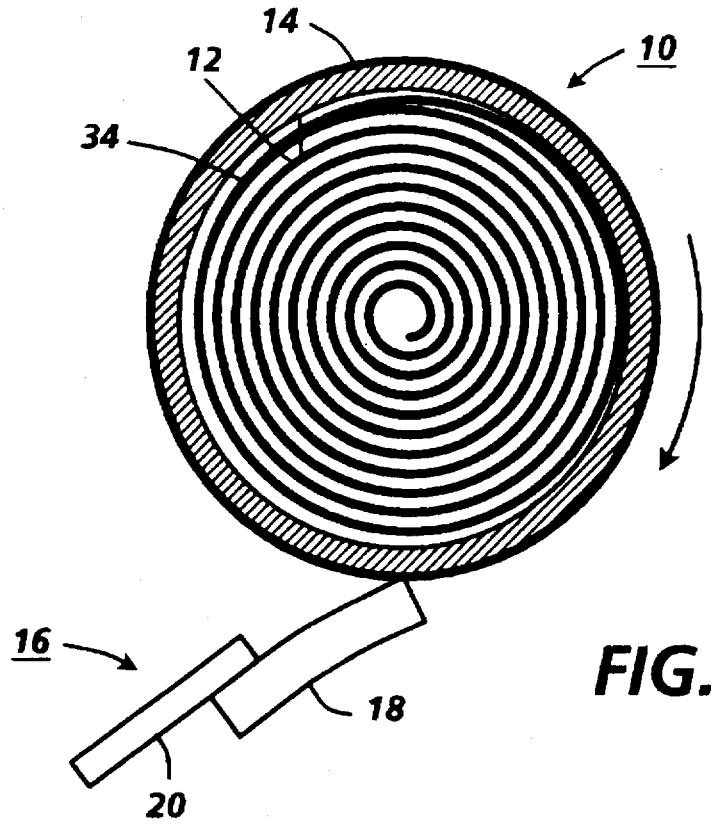
FIG. 7 illustrates a cross-sectional view of a cylindrical electrostatographic imaging member containing rolled acoustic dampening sheets.

Illustrated in FIG. 7, is an electrostatographic imaging member assembly similar to the member illustrated in FIG. 6 except that a porous gas filled acoustic dampening member in the shape of a rolled sheet 34 is substituted for the folded porous sheet 32. Rolled sheet 34 should have sufficient restorative forces to hold it in place so that the outermost surface of the rolled sheet 34 is in firm pressure contact with the interior surface of cylindrical substrate 12. Sheet 34 may comprise any suitable porous gas filled acoustic dampening material such as newspaper, paper towels, paper stationery, thin expanded plastic foam sheets, corrugated cardboard, and the like.

Figure 8:
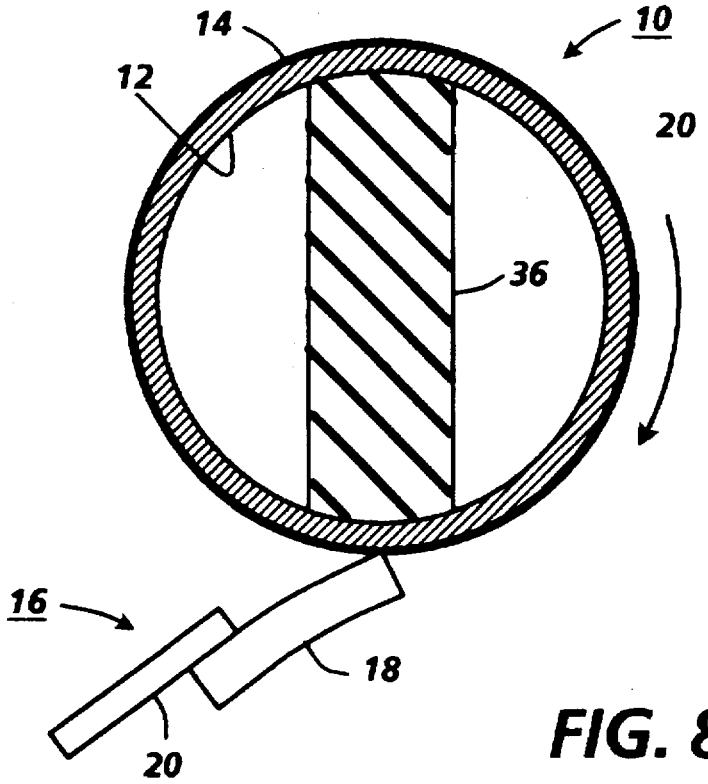
FIG. 8 illustrates a cross-sectional view of a cylindrical electrostatographic imaging member containing slab acoustic dampening material.

In FIG. 8, an electrostatographic imaging member assembly similar to the member illustrated in FIG. 1 is shown except that porous gas filled acoustic dampening slab 36 is in the shape of a block having a substantially rectangular cross section prior to insertion into the hollow interior of cylindrical substrate 12. Slab 36 should be sufficiently large and resilient so that when it is inserted within the interior of electrostatographic imaging member 10, slab 36 is slightly compressed and held in place due to firm pressure contact with the interior back surface of substrate 12. Slab 36 may comprise any suitable porous gas filled acoustic dampening material such as closed and open cell expanded plastic foam, felt slabs, and the like.

Figure 9:
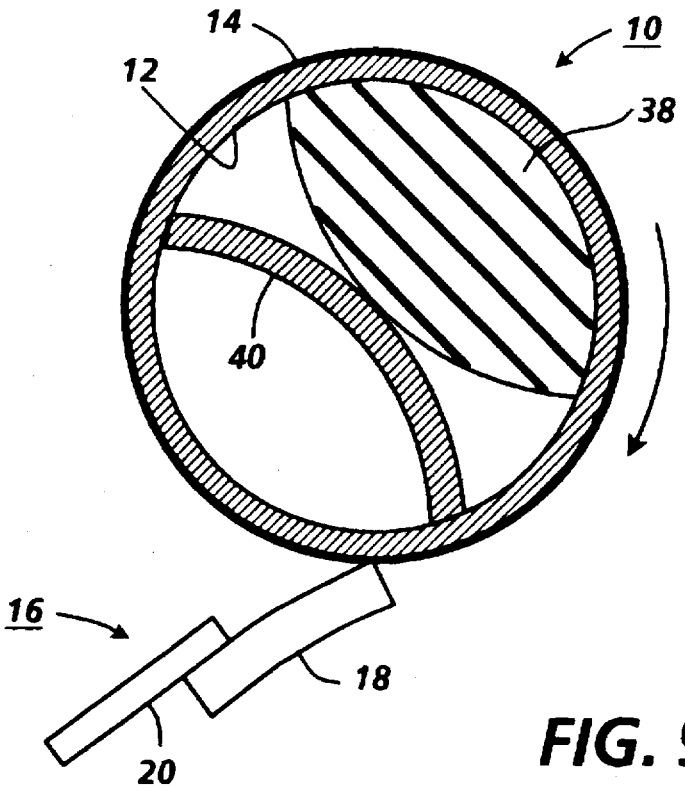
FIG. 9 illustrates a cross-sectional view of a cylindrical electrostatographic imaging member containing an acoustic dampening material held in contact with a portion of the inner circumferential surface of the imaging member by means of a flexible stay.

Referring to FIG. 9, an electrostatographic imaging member assembly is illustrated comprising a hollow electrostatographic imaging drum 10 comprising a hollow cylindrical substrate 12 and at least one electrophotographic imaging layer 14. Shown in contact with the outer imaging surface of electrophotographic imaging layer 14 is a cleaning blade assembly 16 comprising a cleaning blade 18 and cleaning blade holder 20. The hollow electrostatographic imaging drum 10 contains a porous gas filled acoustic dampening member 38 held in place in pressure contact against the interior back surface of hollow cylindrical substrate 12 by a flexible stay 40. Flexible stay 40 may comprise any suitable flexible material such as plastic, spring steel, beryllium steel, and the like. Any other suitable retaining means may be substituted for the flexible stay 40. For example, one or more compressed coil springs, inflatable pneumatic bags or the like may be employed in place of or in addition to stay 40 to partially compress porous gas filled acoustic dampening member 38 and hold it in place in pressure contact against the interior back surface of hollow cylindrical substrate 12. The use of preformed dampening member 38 greatly simplifies the time and expense for assembly, disassembly and recycling. Dampening member 38 may comprise any suitable porous gas filled acoustic dampening material such as expanded plastic foam, and the like.

Figure 10:
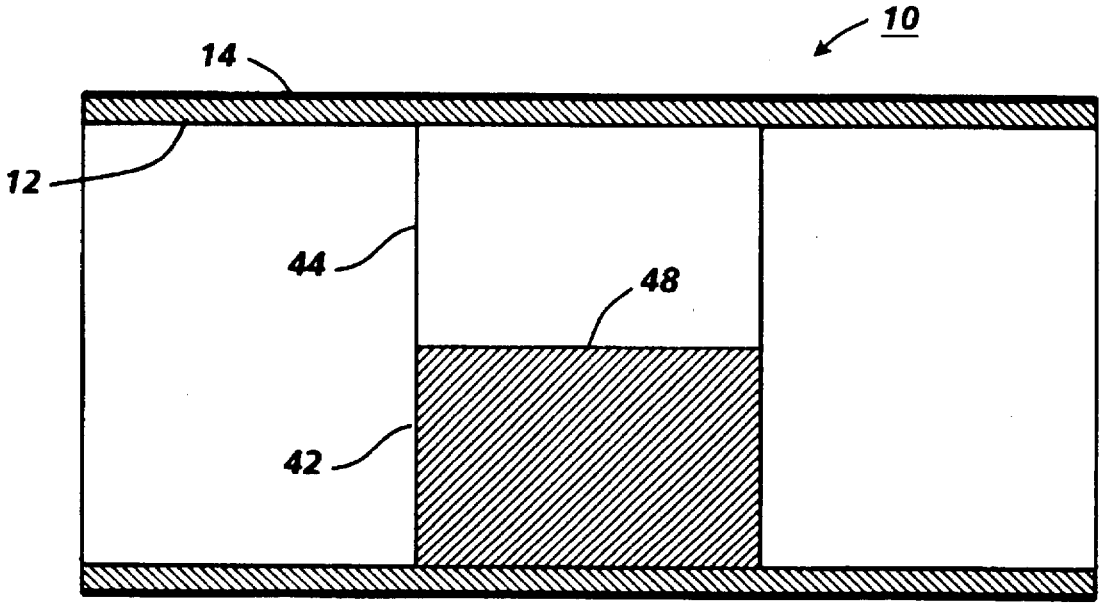
FIG. 10 illustrates a longitudinal cross-sectional view of a cylindrical electrostatographic imaging member containing a slotted acoustic dampening cylinder in the central section between the ends of the cylinder.

In FIG. 10, an embodiment is shown in which a slotted porous gas filled acoustic dampening member 42 in firm pressure contact with a region of the interior surface of hollow cylindrical substrate 12 located from each end of imaging member at a distance of at least about one third of the length of cylindrical imaging member 10. Prior to compression for insertion into the interior of the hollow cylindrical photoreceptor, dampening member 42 has an outside diameter in the relaxed state of larger than the inside diameter of hollow cylindrical substrate 12. Cylindrical substrate 12 has a slot extending along its length parallel to its axis. The slot has a "V" shaped cross section with the width at the outside diameter of the slotted cylindrical substrate 12 being the wider part of the "V" with each slot side 44 tapering down to a slot bottom 48 located at the center of the slotted cylinder. This illustrates that the region of contact between the porous gas filled acoustic dampening member 42 and the interior surface of hollow cylindrical substrate 12 need not necessarily extend the entire length of hollow cylindrical substrate 12 and can be be as little as one third of the length of the length of cylindrical imaging member 10.

Referring to FIG. 10, a cross-sectional view taken longitudinally along the axis of electrostatographic imaging member 10 shown. An acoustic dampening sleeve 42 is shown in firm pressure contact with the internal surface of substrate 12. Sleeve 42 is similar in construction and materials composition as sleeve 28 as shown in FIG. 5.

Any suitable preformed compressible resilient porous gas filled acoustic dampening member may be used in contact with the back surface of an electrostatographic imaging member assembly comprising an electrostatographic imaging member. The dampening means should be porous and contain gas filled cavities. The presence of gas in the dampening means is important because it is compressible and facilitates pressure contact with the back surface of the imaging member substrate. It is believed that imaging member resonance may be due a feedback phenomenon. The feedback appears to be due to an interaction between the cleaning blade and the imaging surface. The acoustic dampening means of this invention prevents such feedback. The vibrational energy transmitted to the partially compressed porous material causes the porous material to vibrate which in turn causes friction between the porous material the adjacent gas molecules as well as reflection and refraction of sound energy between cells each time the sound energy is absorbed thereby dissipating the vibrational energy. It is believed that this property causes the vibrational energy to be converted into heat energy through friction between solid material and adjacent gas molecules to convert the acoustic energy to heat energy. Sufficient energy must be absorbed by the acoustic dampening material to prevent squealing or howling, i.e., to prevent build up of sympathetic acoustic resonance of the drum due to cleaning blade sticking and slipping. In other words, the sound energy must be absorbed before feedback occurs. Thus, the porous gas filled acoustic dampening member utilized absorbs sound energy when placed in intimate compressive contact with the imaging member. The gas filled cavities may comprise open passages such as found in felt or open cell foam or it can comprise a plurality of closed cell cavities such as found in closed cell foam. The cavities may have any suitable shape such as spherical, oval, angular or the like. Also, the cavities may be of the same or different sizes. A typical average cavity diameter is about 5 micrometers, however, larger or smaller average cavity sizes may be utilized where suitable. Any suitable gas may be utilized. Typical gases include, for example, air, nitrogen, carbon dioxide, argon and the like. The solids in the porous dampening means of this invention should have a relatively large amount of surface area in contact with a gas. The acoustic dampening means is only partially compressed after installation and should retain sufficient gas molecules to assist in converting vibrational energy into heat energy. The acoustic dampening means of this invention should also have a compressibility factor of at least two to one and still return to its original shape. The acoustic dampening member should also be preformed prior to installation in the imaging member. In other words, prior to compression for insertion into the interior of the imaging member, it should have a definite shape to which it can return to after compressive pressure is applied and released. A preformed acoustic dampening member can easily be slid into place within the interior of the imaging member manually or by robotic means and readily removed for recycling at the end of imaging life of the imaging member. The degree of partial compression existing in the acoustic dampening member after installation also depends upon the resiliency of the acoustic dampening material used and the distortion resistance of the substrate utilized. Thus, for example, the amount of acoustic dampening member compression utilized for thin substrates should not be so great as to cause undesirable distortion of the substrate after installation of the acoustic dampening member. Materials such as solid rubber are compressible and return to their original shape, but do not contain a gas and are not compressible at a compressibility factor of at least two to one. Materials having a large mass are generally expensive to make, install, recycle, clean and reinstall. Also, high mass materials can impede acceleration of the cylindrical electrostatographic imaging member to operating speeds. Liquids should normally be avoided because liquids are not compressible. Compressibility, including the property of returning to its original shape, is important in order to cause the partially compressed compressible material to remain in place after installation in pressure contact with the back surface of the imaging member substrate as well as absorb sound energy. The porous materials preferably has a low mass. Preferred porous dampening means material include cork, sponge, felt, paper, cardboard, textile, opened cell foam, closed cell foam, and the like. Typical foam materials include, for example, polyurethane foam, expanded polystyrene foam, expanded polyethylene foam, and the like.

When utilized with cylindrical electrostatographic imaging members, the acoustic dampening means should rotate with the imaging member cylinder. Thus, the contact between the partially compressed acoustic dampening material and the inner surface of the cylindrical electrostatographic imaging member should be firm and sufficient to keep the acoustic dampening material in place so that it does not move or migrate.

The acoustic dampening means should also be positioned in contact with at least the backside of the imaging member at or near the middle of the imaging member between the ends of a drum or the sides of a web. The percent of the length of the cylindrical electrostatographic imaging member in contact with the acoustic dampening material depends on factors such as the type of acoustic dampening material utilized and the circumferential arc contacted. Generally, at least about 10 percent of the length of the cylindrical electrostatographic imaging member is contacted with the acoustic dampening material. Preferably, contact should be with at least part of the region between about 33 percent to about 66 percent from one end of the drum or side of a web to the other end or side. Although an electrophotographic imaging drum may vibrate at three or four frequencies, the undesirable squealing or howling sound is believed to be due to a fundamental frequency having a node at the center of the drum. Thus, for a drum or cylinder, the porous gas filled acoustic dampening member is preferably in contact with a region of the hollow interior surface of the drum located from each end of the imaging member at a distance of up to about one third of the length of said cylindrical imaging member. Where a drum is utilized, and the region of contact between the porous gas filled acoustic dampening member and the interior surface of the drum is as little as between about 33 percent and about 66 percent of the length of the drum, the acoustic dampening member need not be in continuous contact with the entire circumferential band within that region. The effectiveness of the dampening material diminishes as the point of contact is further from the center of the drum and approaches one or the other end of the drum.

Instead of continuous contact, a plurality of segments of the interior surface of the drum may be contacted by the acoustic dampening member. Generally, satisfactory results may be achieved when the sum of segmental contacts by the acoustic dampening member along a circumferential band extending around the interior of the drum equals at least about 85 percent of the circumference. Preferably the porous gas filled acoustic dampening member is in contact with at least about 90 percent of the interior circumference of the hollow interior surface of an electrostatographic imaging member. Optimum results are achieved when contact includes at least about 95 percent of the interior circumference. Since the area of each zone of segmental contact circumferentially or axially along a drum interior surface can be large or small and since the degree of acoustic damping can vary with the specific dampening, substrate and blade materials employed, some experimentation is desirable with specific combinations of materials utilized to determine the minimum amount contact sufficient to eliminate the undesirable squealing or howling sound created during contact between the imaging member and cleaning blade.

Where the acoustic dampening material is in the form of a sleeve such as illustrated, for example, in FIG. 4, the acoustic dampening material may be as thin as the thickness of one cell. However, the acoustic dampening material should be sufficiently thick to retain compressible properties which maintain the sleeve in firm pressure contact with the inner surface of the cylindrical electrostatographic imaging member.

The electrostatographic imaging member may comprise an electrophotographic imaging member or an electrographic imaging member. Electrophotographic imaging members and electrographic imaging members are well known in the art and may be of any suitable configuration such as, for example, a hollow cylinder or flexible belt. Electrostatographic imaging members usually comprise a supporting substrate having an electrically conductive surface. Electrophotographic imaging members also comprise at least one photoconductive layer. A blocking layer may optionally be positioned between the substrate and the photoconductive layer. If desired, an adhesive layer may optionally be utilized between the blocking layer and the photoconductive layer. For multilayered photoreceptors, a charge generation layer is usually applied onto the blocking layer and a charge transport layer is subsequently formed over the charge generation layer. For electrographic imaging members, an electrically insulating dielectric layer is applied directly onto the electrically conductive surface.

The supporting substrate may be opaque or substantially transparent and may comprise numerous materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate may be rigid or flexible and in the form of a hollow cylinder, an endless flexible belt or the like.

The thickness of the supporting substrate layer depends on numerous factors, including beam strength, mechanical toughness, and economical considerations. Typical substrate layer thicknesses used for a flexible belt application may be of substantial thickness, for example, about 125 micrometers, or of a minimum thickness of not less than about 50 micrometers, provided that it produces no adverse effects on the belt. Typical substrate layer thicknesses used for a hollow cylinder application may range from about 25 micrometers to about 1,500 micrometers.

The conductive layer may vary in thickness over substantially wide ranges depending on the optical transparency and degree of flexibility desired for the electrostatographic member. If the substrate is electrically conductive, a separate conductive layer may be unnecessary. For example if the substrate is a metal such as an electroformed nickel or thin walled aluminum tube, a separate conductive layer may be omitted.

An optional hole blocking layer may be applied to the substrate or conductive layer for photoreceptors. The hole blocking layer should be continuous and have a dry thickness of less than about 0.2 micrometer. An optional adhesive layer may be applied to the blocking layer. Any suitable adhesive layer well known in the art may be utilized. Satisfactory results may be achieved with the adhesive layer thickness between about 0.05 micrometer and about 0.3 micrometer.

Any suitable charge generating (photogenerating) layer may be applied onto the adhesive layer, blocking layer or conductive layer. Charge generating layers are well know in the art and can comprise homogeneous layers or photoconductive particles dispersed in a film forming binder. Examples of charge generating layers are described, for example, in U.S. Pat. No. 3,357,989, U.S. Pat. No. 3,442,781, and U.S. Pat. No. 4,415,639, the disclosures thereof being incorporated herein in their entirety. Other suitable photogenerating materials known in the art may also be utilized, if desired.

Any suitable polymeric film forming binder material may be employed as the matrix in of the photogenerating layer. Typical polymeric film forming materials include those described, for example, in U.S. Pat. No. 3,121,006, the disclosure thereof being incorporated herein in its entirety.

The photogenerating composition or pigment may be present in the film forming binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition.

The photogenerating layer generally ranges in thickness from about 0.1 micrometer to about 5 micrometers, preferably from about 0.3 micrometer to about 3 micrometers. The photogenerating layer thickness is related to binder content. Higher binder content compositions generally require thicker layers for photogeneration.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer should exhibit negligible, if any, discharge when exposed to a wavelength of light useful in electrophotography. The charge transport layer in conjunction with the charge generating layer is an insulator to the extent that an electrostatic charge placed on the charge transport layer is not conducted in the absence of illumination. Charge transport layer materials are well known in the art.

The charge transport layer may comprise activating compounds or charge transport molecules dispersed in normally, electrically inactive film forming polymeric materials. These charge transport molecules may be added to polymeric film forming materials. An especially preferred charge transport layer employed in multilayer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)phenylmethane; 4'-4"-bis(diethylamino)-2', 2"-dimethyltriphenylmethane; N,N'-bis (alkylphenyl)-(1,1'-biphenyl)-4,4'-diamine wherein the alkyl is, for example, methyl, ethyl, propyl, n-butyl, etc.; N,N'-diphenyl-N,N'-bis (3"-methylphenyl) -(1,1'biphenyl)-4,4'diamine; and the like, dispersed in an inactive resin binder.

Any suitable inactive resin binder may be employed. Typical resin binders include polycarbonate resins, polyvinylcarbazole, polyester, polyarylate, polyacrylate, polyether, polysulfone, and the like. Molecular weights can vary from about 20,000 to about 150,000.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers.

For electrographic imaging members, a flexible dielectric layer overlying the conductive layer may be substituted for the photoconductive layers. Any suitable, conventional, flexible, electrically insulating dielectric polymer may be used in the dielectric layer of the electrographic imaging member.

This invention will further be illustrated in the following, non-limiting examples, it being understood that these examples are intended to be illustrative only and that the invention is not intended to be limited to the materials, conditions, process parameters and the like recited therein.

EXAMPLE I

A photoconductive imaging member was provided comprising a hollow cylindrical photoreceptor having a length of 35.56 centimeters (14 inches) and an outside diameter of 39.5 millimeters. This photoreceptor comprised an aluminum substrate having thickness of 1 millimeter, a thin polysiloxane charge blocking layer, a charge generating layer having a thickness of 0.8 micrometer and comprising photoconductive pigment particles dispersed in a film forming binder, and a charge transport layer having a thickness of 20 micrometers and comprising an arylamine dissolved in a polycarbonate binder. The imaging member was rotated around its axis at 25.8 rpm and brought into contact with a resilient polyurethane elastomer cleaning blade. The cleaning blade was maintained in a doctoring or chiseling attitude during contact with the outer imaging surface of the rotating photoconductive imaging member. Contact between the cleaning blade and the moving imaging surface caused the production of a loud ringing or squeaking sound.

EXAMPLE II

The procedures described in Example I was repeated with the identical materials except that the hollow cylindrical photoreceptor was stuffed lightly with crumpled up paper towel in pressure contact with the inner surface of the hollow cylindrical photoreceptor for a longitudinal distance of between about 38 millimeters and about 51 millimeters near the center of the hollow cylindrical photoreceptor. The crumpled up paper towel was partially compressed after installation in the photoreceptor and rotated with the photoreceptor without slippage. Prior to insertion into the interior of the hollow cylindrical photoreceptor, the crumpled up paper towel was compressible at a ratio of at least about 2:1 and would still return to its original shape. No audible squeaking or ringing sound was produced. When the paper stuffing was removed and the hollow cylindrical photoreceptor run against the cleaning blade, the photoreceptor exhibited a loud squeaking or ringing sound.

EXAMPLE III

A photoconductive imaging member was provided comprising a hollow cylindrical photoreceptor having a length of 340 millimeters and an outside diameter of 84 millimeters and an inside diameter of 82 millimeters. This photoreceptor had an aluminum substrate having thickness of 1 millimeter, a thin polysiloxane charge blocking layer, a charge generating layer having a thickness of 0.8 micrometer and comprising photoconductive pigment particles dispersed in a film forming binder, and a charge transport layer having a thickness of 20 micrometers and comprising an arylamine dissolved in a polycarbonate binder. The imaging member rotated around its axis at 22.7 rpm and brought into contact with a polyurethane elastomer cleaning blade. The cleaning blade was maintained in a doctoring or chiseling attitude during contact with the outer imaging surface of the rotating photoconductive imaging member. Contact between the cleaning blade and the moving imaging surface caused the production of a loud ringing or squeaking sound.

EXAMPLE IV

The procedures described in Example III was repeated with the identical materials except that the hollow cylindrical photoreceptor a slotted cylinder of expanded polyethylene foam, having a length of 80 millimeters and a density of 1.6 pounds per cubic feet, was stuffed into the interior of the hollow cylindrical photoreceptor near the center of the photoreceptor where it lodged in pressure contact with the interior surface of the hollow cylindrical photoreceptor. The slotted cylinder had a shape similar to the slotted cylinder illustrated in FIG. 10. Prior to compression for insertion into the interior of the hollow cylindrical photoreceptor, the slotted cylinder had an outside diameter in the relaxed state of 84 millimeters and a slot extending along the length of the slotted cylinder parallel to the slotted cylinder axis. The slot had a "V" shaped cross section with a 10 millimeter width at the outside diameter of the slotted cylinder with the slot sides tapering down to a slot bottom located at the center of the slotted cylinder. The bottom of the slot had a width 1 millimeter. The slotted cylinder was compressible at a ratio of at least about 2:1 and would still return to its original shape when compression pressure was released. The slotted cylinder remained partially compressed after installation and rotated with the photoreceptor without slippage. No audible squeaking or ringing sound was produced. When the slotted cylinder was removed and the hollow cylindrical photoreceptor run against the cleaning blade, the photoreceptor exhibited a loud squeaking or ringing sound.

The invention has been described in detail with particular reference to preferred embodiments thereof but it will be understood that variations and modifications can be effected within the spirit and scope of the invention as described herein above and as defined in the appended claims.

What is claimed is:

1. An electrostatographic imaging member assembly comprising an electrostatographic imaging member comprising a substrate, an electrostatographic imaging layer, an imaging surface on said imaging layer, a back surface on said substrate, and a preformed resilient porous gas filled acoustic dampening member at least partially compressed and in pressure contact with said back surface, said pressure contact being sufficient to substantially eliminate relative movement between said substrate and said acoustic dampening member wherein at least about 10 percent of the length of said interior back surface of said imaging member is in pressure contact with said preformed porous gas filled acoustic dampening member and wherein said preformed porous gas filled acoustic dampening member is in the shape of chips.

2. An electrostatographic imaging member assembly comprising an electrostatographic imaging member comprising a substrate, an electrostatographic imaging layer, an imaging surface on said imaging layer, a back surface on said substrate, and a preformed resilient porous gas filled acoustic dampening member at least partially compressed and in pressure contact with said back surface, said pressure contact being sufficient to substantially eliminate relative movement between said substrate and said acoustic dampening member wherein at least about 10 percent of the length of said interior back surface of said imaging member is in pressure contact with said preformed porous gas filled acoustic dampening member and wherein said preformed porous gas filled acoustic dampening member is held in place against said hollow interior of said electrostatographic imaging member by a flexible stay.

3. An electrostatographic imaging member assembly comprising an electrostatographic imaging member comprising a substrate, an electrostatographic imaging layer, an imaging surface on said imaging layer, a back surface on said substrate, and a preformed resilient porous gas filled acoustic dampening member at least partially compressed and in pressure contact with said back surface, said pressure contact being sufficient to substantially eliminate relative movement between said substrate and said acoustic dampening member wherein at least about 10 percent of the length of said interior back surface of said imaging member is in pressure contact with said preformed porous gas filled acoustic dampening member and wherein said preformed porous gas filled acoustic dampening member is in the shape of a hollow split sleeve having a substantially cylindrically shaped inner surface, a substantially cylindrically shaped outer surface and a gap extending radially from said cylindrically shaped outer surface to said cylindrically shaped inner surface and extending longitudinally from one end of said hollow split sleeve to the other.

4. An electrostatographic imaging member assembly according to claim 3 wherein said gap extends longitudinally of said sleeve parallel to an imaginary axis of said sleeve.

5. An electrostatographic imaging member assembly according to claim 3 wherein said gap extends in a spiral pattern from one end of said sleeve to the other.

* * * * *